United States Patent [19]

Nash

[11] 4,059,773

[45] Nov. 22, 1977

[54] SWITCH CONTROLLED POWER RECEPTACLE SYSTEM

[76] Inventor: Charles A. Nash, P.O. Box 1271, Chautauqua, N.Y. 14722

[21] Appl. No.: 705,563

[22] Filed: July 15, 1976

[51] Int. Cl.[2] ..... H01R 33/30

[52] U.S. Cl. ..... 307/115; 200/51.1

[58] Field of Search ..... 200/51.09, 51.1, 51.02, 200/51.03, 51.04, 61.19, 153 M; 307/112, 113, 115

[56] References Cited

U.S. PATENT DOCUMENTS 2,609,409 9/1952 Radeke ..... 200/51.1 X

FOREIGN PATENT DOCUMENTS 1,111,272 7/1961 Germany ..... 200/51.09

*Primary Examiner*—Thomas J. Kozma

*Attorney, Agent, or Firm*—Clarence A. O'Brien; Harvey B. Jacobson

[57] ABSTRACT

An electrical appliance having a switch controlled plug type connector may be plugged into any one of a plurality of power terminal receptacles connected to a power line through a wall switch or the like. Common ground and neutral conductors are interconnected in parallel with said receptacles while current carrying conductors interconnect in series normally closed contact pairs in each receptacle. The normally closed contacts in each receptacle are opened in response to insertion of the connector to complete an operating circuit and block completion of other operating circuits further from the power source.

9 Claims, 4 Drawing Figures

SWITCH CONTROLLED POWER RECEPTACLE SYSTEM

BACKGROUND OF THE INVENTION

This invention relates to switch controlled circuits for electrical appliances.

The concept of providing a plurality of spaced power terminal receptacles connected in series to a power source for supply of current to an appliance plugged into a selected one of the receptacles, is disclosed for example in U.S. Pat. No. 2,313,452 to O'Brien. U.S. Pat. No. 3,523,212 to Murphy also shows that a series connection at a plug-in receptacle may be interrupted while completing a circuit to an appliance at such receptacle. The use of 3-way switches for plug-in wiring arrangements for powering appliances is also known as shown in U.S. Pat. No. 1,568,584 to Blankenship. However, despite the foregoing prior art arrangements and power circuit switching techniques, no power supply systems have been devised whereby an electrical appliance may be plugged into any one of a plurality of power terminal receptacles for operation under control of switches both at the power source and at the appliance itself and wherein only a single receptacle closest to the power source will be operative at one time.

It is therefore an important object of the present invention to provide a plurality of series connected power supply receptacles through which power may be furnished to an appliance under switch control at a single selected location.

SUMMARY OF THE INVENTION

A power supply line of an AC power source, for example, is connected through a 3-way wall switch to one of a plurality of power receptacles through which two alternative power circuits are established between the power source and an electrical appliance plugged into any one of the receptacles. Each of the receptacles is connected in parallel to common neutral and ground lines while they are interconnected in series through current carrying conductors between normally closed contacts associated with each receptacle. The prongs of a plug type connector to which the appliance is connected through a 3-way switch, open the normally closed contacts and thereby interrupt extension of the operating circuit to all other receptacles further from the power source.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF PREFERRED EMBODIMENT

Figure 1:
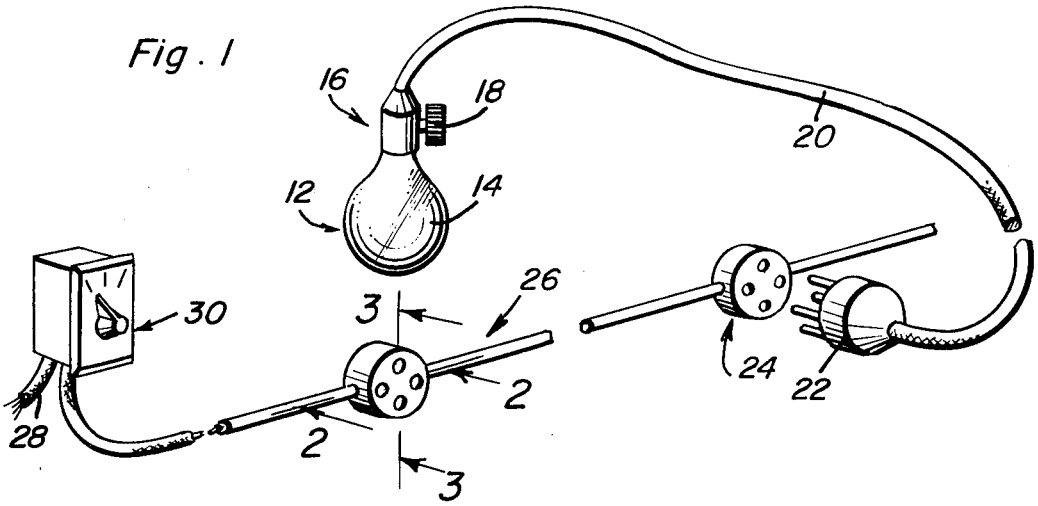
FIG 1 is a perspective view showing a typical wiring arrangement of components in accordance with the present invention.

Referring now to the drawings in detail, FIG. 1 illustrates a typical wiring arrangement numeral through which electrical energy may be supplied to an electrical appliance or load such as a lamp 12. The lamp is in the form of an incandescent bulb 14 screwed into a lamp base socket 16 that is conventional except for its associated with a three-way switch 18 and a power cord 20 to which a four-prong connector 22 is connected at an end opposite socket 16. The connector 22 is adapted to be plugged into any one of a plurality of power terminal receptacles 24 interconnected in spaced relation to each other by an electrical conduit 26. The receptacles as shown are supplied with electrical energy from a power line 28 through a wall mounted, three-way switch assembly 30.

Figure 4:
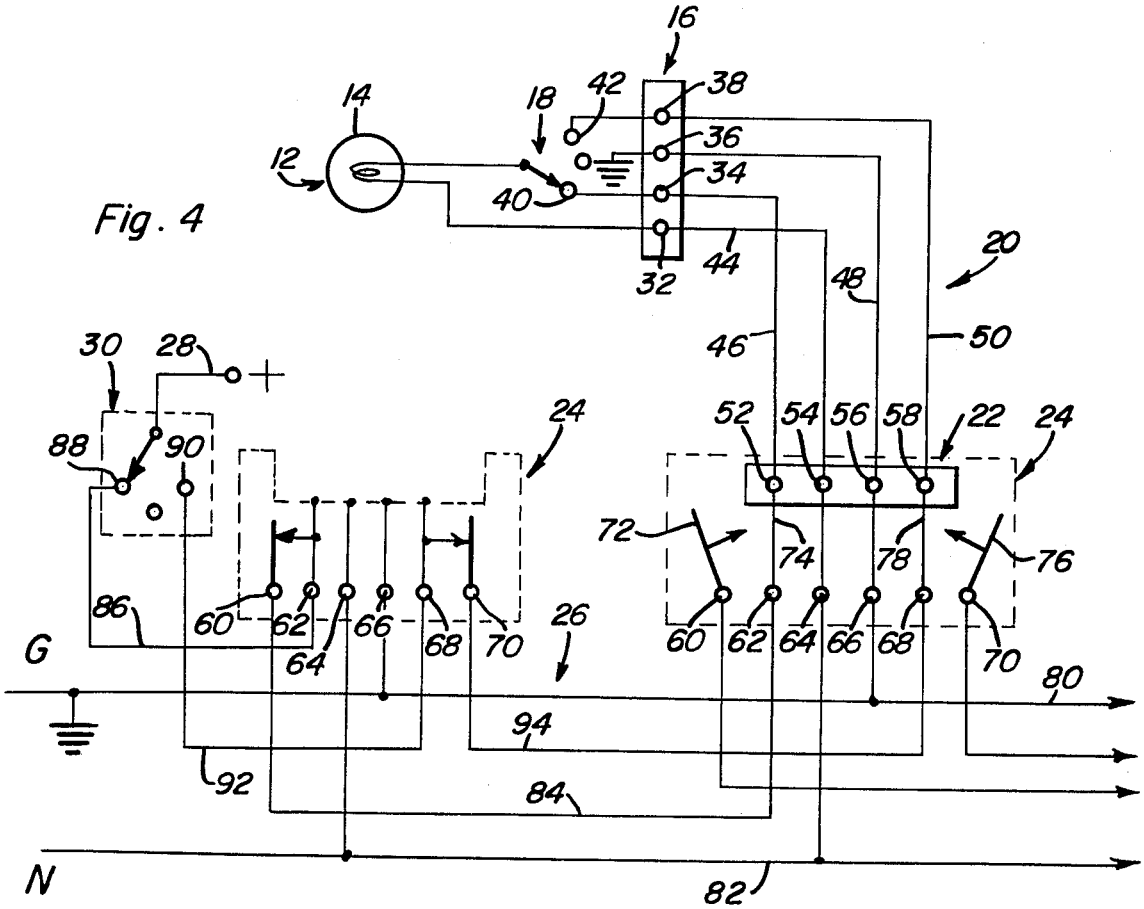
FIG. 4 is an electrical circuit diagram illustrating the system of the present invention.

FIG. 4 illustrates the circuitry associated with the system corresponding to that of FIG. 1 wherein the filament of lamp 12 is connected to the switch 18 and to terminal 32 of the socket 16 which is also provided with terminals 34, 36 and 38 respectively connected to switch contact 40, ground and switch contact 42. The terminals 32, 34, 36 and 38 are respectively connected by conductors 44, 46, 48 and 50 in the power cord to prongs 52, 54, 56 and 58 of the connector 22.

Figure 2:
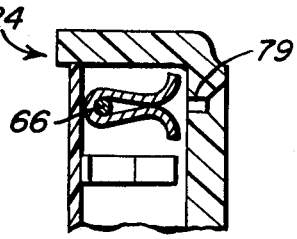
FIG. 2 is a partial sectional view taken substantially through a plane indicated by section line 2—2 in FIG. 1.
Figure 3:
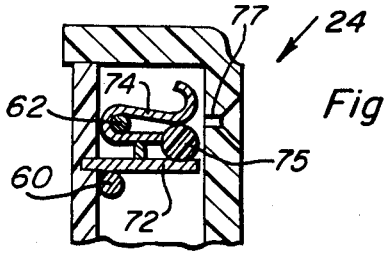
FIG 3 is a partial sectional view taken substantially through a plane indicated by section line 3—3 in FIG. 1.

Each of the receptacles 24 as shown in FIGS. 2, 3 and 4 is connected to the electrical cable or conduit 26 through six terminals 60, 62, 64, 66, 68 and 70. The terminals 60 and 62 are respectively connected to relatively movable contacts 72 and 74 that form a normally closed contact pair as shown in FIG. 3. The contacts are opened in response to insertion of the pronged connector 22 into the receptacle. FIGS. 2 and 3 show, by way of example only, a structural arrangement conforming to what is schematically shown in FIG. 4. The prong 52 associated with connector 22 when inserted into the receptacle 24 through a bore 77 aligned with terminal 62, engages contact 74 and through a non-conductive ball element 75, shown in FIG. 3, displaces contact 72 out of engagement with contact 74. A second pair of normally closed contacts 76 and 78 are provided. The contacts 74 and 78 are adapted to be electrically connected by prongs 52 and 58 of the connector to the conductors 46 and 50 while the prongs 54 and 56 electrically connect terminals 64 and 66 to conductors 44 and 48. The prong 56 when inserted into the receptacle 24 through a bore 79 aligned with terminal 66 as shown in FIG. 2, makes contact with terminal 66. Electrical contact between prong 54 and terminal 64 may be established in a similar fashion.

The electrical cable 26 includes a ground conductor 80 connected in parallel to the terminals 66 of each receptacle 24 while a neutral conductor 82 is connected in parallel to each of the terminals 64. Conductor 84 interconnects terminals 60 and 62 of adjacent receptacles in a direction away from the power source at switch assembly 30. The terminal 62 of the receptacle closest to the switch 20 is connected by a conductor 86 to one contact 88 of the switch. The other operative switch contact 90 is connected by conductor 92 to the terminal 68 of the closest receptacle. The conductors 94 interconnect the terminals 70 and 68 of adjacent receptacles in a direction away from the power source.

It will be appreciated that any number of receptacles may be utilized interconnected in series with the power line 28 through switch 30 as shown in FIG. 4. Normally, the contact pairs 72–74 and 76–78 of the receptacle are closed as shown in the left-hand receptacle in FIG. 4 so as to extend the power circuit from either switch contact 88 or 90 to the next receptacle in a direction away from the power source. The circuit is terminated at the receptacle closest to the power source into which a connector 22 is plugged as shown at the right-hand receptacle 24 in FIG. 4. At this receptacle, an operating circuit is completed through the lamp 12 when the switch 18 is in a position corresponding to that of switch 30. Obviously, several different types of appliances equipped with three-way switches 18, power cords 20 and connectors 22 may be utilized and plugged into selected receptacles. Only a single appliance may, however, be operative at one time and only the switched-on appliance closest to the power switch 30 will be operative.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a source of electrical energy, a system of supplying said electrical energy to an electrically operated device, comprising a plurality of plug-in receptacles, a connector device having a plurality of prongs adapted to be inserted into any selected one of said receptacles, means electrically connecting said connector device to the electrically operated device for completing an operating circuit through the electrically operated device, each of said plug-in receptacles having normally closed contact means opened in response to insertion of the prongs into the receptacle, and electrical conduit means interconnecting the receptacles with said source for establishing said operating circuit only through the opened contact means of the selected one of the receptacles in series with the normally closed contact means of those receptacles located between the selected one of the receptacles and the source of electrical energy.

2. The combination of claim 1 including switch means interconnecting the source and the electrically operated device with the conduit means and the connector device respectively.

3. The combination of claim 2 wherein said contact means includes a pair of contact elements interconnected with the conduit means and means biasing said contact elements into engagement with each other.

4. The combination of claim 3 wherein said conduit means includes current carrying conductors interconnected between said contact means and a common conductor connected in parallel to said receptacles, each of said receptacles having connector terminals respectively connected to the common conductor and to one of the contact elements of the contact means, said connector terminals adapted to be engaged by the prongs of the connector device.

5. The combination of claim 1 wherein said conduit means includes current carrying conductors interconnected between said contact means and a common conductor connected in parallel to said receptacles, each of said receptacles having connector terminals respectively connected to the common conductor and to the contact means, said connector terminals adapted to be engaged by the prongs of the connector device.

6. The combination of claim 1 wherein said contact means includes a pair of contact elements interconnected with the conduit means and means biasing said contact elements into engagement with each other.

7. The combination of claim 6 wherein said conduit means includes current carrying conductors interconnected between said contact means and a common conductor connected in parallel to said receptacles, each of said receptacles having connector terminals respectively connected to the common conductor and to one of the contact elements of the contact means, said connector terminals adapted to be engaged by the prongs of the connector device.

8. In combination with a source of electrical energy electrically connected to a plurality of terminal devices and connector means establishing an operating circuit by engagement with any selected one of said terminal devices, said terminal devices each including a pair of normally closed contact elements opened in response to said engagement of the connector means with the associated terminal device alternatively extending the operating circuit to another of the terminal devices or completing the operating circuit only at the terminal device associated therewith.

9. The combination of claim 8 including multi-position switch means interconnecting the source to the terminal devices and the connector means to a load for establishing at least two alternative operating circuits.

* * * * *